United States Patent [19]

Alden et al.

[11] Patent Number: 4,884,556

[45] Date of Patent: Dec. 5, 1989

[54] ZERO CLEARANCE FIREPLACE

[75] Inventors: Frank Alden, Marlboro, Mass.; James A. Wyatt, Randolph, Vt.

[73] Assignee: Vermont Castings, Inc., Randolph, Vt.

[21] Appl. No.: 274,715

[22] Filed: Nov. 17, 1988

Related U.S. Application Data

[63] Continuation of Ser. No. 25,528, Mar. 13, 1987, abandoned.

[51] Int. Cl.[4] ..... F24B 7/00

[52] U.S. Cl. ..... 126/546; 126/545; 126/190; 126/197; 237/55; 49/177; 49/209

[58] Field of Search ..... 126/544, 545, 546, 547, 126/190, 198, 197, 194, 200, 285 A, 285 B; 160/DIG. 9, 29; 237/51.55; 49/161, 176, 177, 178, 209

[56] References Cited

U.S. PATENT DOCUMENTS

| | | | |
|---|---|---|---|
| 244,397 | 7/1881 | Matthews | 126/121 |
| 470,244 | 3/1892 | Howe | 126/135 |
| 579,987 | 4/1897 | Jordan | 126/120 |
| 1,213,173 | 1/1917 | Evans | 126/120 |
| 1,726,854 | 9/1929 | Mumford | 126/202 |
| 1,727,228 | 9/1929 | Claybauch et al. | 126/121 |
| 1,763,896 | 6/1930 | Leindorf et al. | 49/177 |
| 2,172,356 | 9/1939 | Brainard | 126/138 |
| 2,308,548 | 1/1943 | Schuler et al. | 49/177 |
| 2,775,239 | 12/1956 | Bucci | 126/546 |
| 2,803,241 | 8/1957 | Chapla | 126/202 |
| 3,224,382 | 12/1965 | Floehr | 49/209 |
| 3,994,274 | 11/1976 | Manno | 126/142 |
| 4,058,932 | 11/1977 | Peterson et al. | 49/177 |
| 4,059,091 | 11/1977 | Cobb | 126/140 |
| 4,086,906 | 5/1978 | Reichgut | 126/140 |
| 4,169,458 | 10/1979 | Shaw | 126/120 |
| 4,183,348 | 1/1980 | Smith | 126/140 |
| 4,270,514 | 6/1981 | Berry, Jr. | 126/140 |
| 4,271,815 | 6/1981 | Johnson | 126/121 |
| 4,287,871 | 9/1981 | Schumann et al. | 126/67 |
| 4,294,224 | 10/1981 | Luther, Sr. | 126/135 |
| 4,432,164 | 2/1984 | Baguet | 49/209 |
| 4,474,205 | 10/1984 | Dreyer | 126/285 A |
| 4,572,156 | 2/1986 | Lentz | 126/140 |
| 4,574,773 | 3/1986 | Moughamian | 126/121 |
| 4,576,141 | 3/1986 | Lillard | 126/120 |
| 4,583,517 | 4/1986 | Hilton et al. | 126/135 |
| 4,683,868 | 8/1987 | Ferguson et al. | 126/193 |
| 4,704,821 | 11/1987 | Berndt | 49/209 |

FOREIGN PATENT DOCUMENTS

| | | | |
|---|---|---|---|
| 0218513 | 4/1987 | European Pat. Off. . | |
| 2542849 | 9/1984 | France . | |
| 2546611 | 11/1984 | France . | |
| 457705 | 12/1936 | United Kingdom | 126/121 |
| 809426 | 2/1959 | United Kingdom . | |
| 2068530B | 8/1981 | United Kingdom . | |

OTHER PUBLICATIONS

Kawatherm Product Information dated Apr., 1984.

*Primary Examiner*—James C. Yeung
*Attorney, Agent, or Firm*—Wolf, Greenfield & Sacks

[57] ABSTRACT

A prefabricated zero clearance fireplace includes a combustion chamber having a front opening, a glass door sized and shaped for positioning over and sealing the opening and a guide system for guiding vertical movement of the door between a lowered position over the opening and a raised position. The guide system includes tracks that are inwardly offset at their lowermost ends so that the door seals the combustion chamber without friction as the door is raised and lowered. Counterweights permit the door to be easily raised and lowered. For safety, the counterweights cause the door to automatically raise if it is pushed outwardly from the inside. The door is hinged for pivoting outwardly about a vertical axis in the lowered position. An optional motor can be provided for raising and lowering the door. A convection chamber surrounding the combustion chamber permits circulation and heating of room air.

9 Claims, 7 Drawing Sheets

18
95
88
87
2
75
46
77
19
7
92
91
25
23
91
26
34
93
38
94
28
64
10
24
29
27
30
8
20
21
31
9
38
14
64
15
36
17
6
4
83
13
4
16
12
82
85
84
11

75
18
2
77
45
19
76
58
50
60
51
56
54
47
62
35
49
81
78
9
89
79
71
70
61
52
55
53
82
57
48
9
63

50
18
75
51
47
2
54
58
49
78
79
77
19
45
60
70
62
52
58
35
53
55
48
89
71
76
81
61
82
63

77
34
78
80
79
81
35
58
52
61
53
55
49
48

34
39
38
41
40
43
104
100
103
104
100
106
105
42
44
101
42
37
43
40
41
38
39

ZERO CLEARANCE FIREPLACE

This application is a continuation of application Ser. No. 025,528 filed Mar. 13, 1987 now abandoned.

SUBJECT MATTER OF THE INVENTION

This invention relates to a zero clearance fireplace construction for installation in new construction or, in some instances, in existing structures. In particular, the present invention relates to a fireplace that makes use of an outer shell and inner firebox that define a convection air heat exchange passage between the two for heating the interior of a room by movement of air about the sides and bottom of the firebox to and from the room, while combustion air within the firebox is separately introduced into the firebox and is physically isolated from the room interior.

BACKGROUND OF THE INVENTION

Zero clearance fireplaces of the type with which this invention is concerned have been known for some time. These fireplaces generally provide a firebox having a combustion chamber within an outer shell, about which air may be circulated to and from the room. There is no required clearance between the outer shell and the studwork or other structures within which it is retained. The combustion chamber within the firebox is physically separated from the convection air used to heat the room interior. In constructions heretofore in use, including a fireplace construction, exemplified by U.S. Pat. No. 4,574,773, issued Mar. 11, 1986 to Moughamiam, the firebox opening has been closed by a guillotine-type glass panel or door that slides in lateral slides or channels. Similar constructions have been used and disclosed in other patents including U.S. Pat. No. 4,169,459, issued Oct. 2, 1979 to Shaw; U.S. Pat. No. 1,213,173, issued Jan. 20, 1917 to Evans; U.S. Pat. No. 244,397, issued Jul. 19, 1881 to Matthews; and U.S. Pat. No. 579,987, issued Apr. 6, 1897 to Jordan. These and other prior art references including U.S. Pat. No. 1,726,874, issued Sept. 3, 1929 to Mumford; U.S. Pat. No. 2,803,241, issued Aug. 20, 1957 to Chapla; U.S. Pat. No. 4,287,871, issued Sept. 8, 1981 to Schumann; U.S. Pat. No. 2,775,239, issued Dec. 25, 1956 to Bucci; U.S. Pat. No. 4,294,224, issued Oct. 13, 1981 to Luther; U.S. Pat. No. 4,086,906, issued May 2, 1978 to Reichgut; U.S. Pat. No. 4,183,348, issued Jan. 15, 1980 to Smith; U.S. Pat. No. 4,270,514, issued Jun. 2, 1981 to Berry; U.S. Pat. No. 4,059,091, issued Nov. 22, 1977 to Hobb; U.S. Pat. No. 579,987, issued Apr. 6, 1897 to Jordan; U.S. Pat. No. 244,397, issued Jul. 19, 1881 to Matthews; U.S. Pat. No. 4,271,815, issued Jun. 9, 1981 to Johnson; U.S. Pat. No. 4,572,156, issued Feb. 25, 1986 to Lentz; and U.S. Pat. No. 4,576,141, issued Mar. 18, 1986 to Lillard, generally disclose the use of guillotine-type glass door closures in combination with screen closures for fireplace constructions. Nonetheless, these prior art fireplaces appear to have inherent air leaks from the combustion chamber because the glass door seal against the combustion chamber is not particularly tight. In these prior art constructions, spaces between the glass door and the periphery about the combustion chamber opening permitted movement of the air between the combustion chamber and the room. Such air movement makes these fireplaces less efficient.

In addition, the arrangements disclosed in the prior art do not provide suitable means for maintaining a clean glass door. Means are not provided for minimizing deposit of soot on the inner surface of the glass door or for facilitating the cleaning of this glass door on both sides. In addition, those prior art devices in which glass doors were closed in a guillotine-type action, involved hand-operated closing mechanisms. Additionally, these systems had balancing systems, such that the glass door would remain closed if unattended even if not positively locked in a down position. In those systems, no means were provided for easily opening the glass door from within the combustion chamber. As a result, there is an inherent possibility that the glass doors disclosed in prior art guillotine systems might trap a youngster inside the combustion chamber.

These prior art systems, moreover, do not lend themselves for installation in a variety of designs and styles.

SUMMARY OF THE INVENTION

The foregoing problems are largely overcome in the present invention. Additionally, the present invention provides a number of other improved features that were not available in fireplace constructions heretofore in existence.

The present invention provides a high quality and efficient alternative to conventional masonry fireplaces. The present invention provides a fireplace that is capable of being made to appear as a traditional masonry fireplace with substantial visual appeal. In the present invention, the fireplace is provided with a refractory lined fire chamber similar to a conventional fireplace. Additionally, the present invention provides a guillotine-operated glass door that provides an unobstructed view of the fire. The door and the covering screen are moved between open and closed positions with easily operable controls and, in a preferred embodiment, are operable by motor power.

The present invention provides a system in which heat output can be maximized with the ability to design the product with heating efficiency and emissions complying with E.P.A. regulatory requirements proposed for affected solid fuel appliances for the year 1988. Fireplaces made in accordance with the present invention will generate more useful heat than standard masonry fireplaces and will be comparable in heat generation to other zero clearance heat producing units, while nonetheless maintaining a standard masonry fireplace appearance. The present invention also provides means for cleaning the inside surface of the glass door when the fireplace is in use through movement of hot gases across the inner surface of the glass door.

Thus, it is an object of the present invention to provide a fireplace construction of the type generally described, having a glass door that forms an airtight seal over the opening in the firebox combustion chamber only when the door is in its lowermost closed position.

A further object of the present invention is to permit movement of the sliding glass door in a vertical direction without frictional engagement of the door or its frame against the firebox, thus permitting ease in moving the door into an open or stored position from its closed or sealed position.

A further object of the present invention is to provide a fireplace construction having a glass door in which particulate deposit on the inside surface of the glass door is minimized due to the air flow on the inside of the combustion chamber, and in which the glass door may readily be pivoted open for cleaning on both sides of the door.

A further object of the present invention is to provide a means for preventing the glass from accidentally moving upward in its vertical track when the glass door is pivoted in its open position for cleaning.

A further object of the present invention is to provide a motorized means for opening and closing the glass door.

Another object and advantage of the present invention is to provide means for maintaining the glass door normally fully open if left unlatched, or if the glass door is closed, to provide means that permit it to be readily opened if positively pushed from within the combustion chamber. This feature minimizes the likelihood of trapping a child in an airtight combustion chamber.

Another object of the present invention is to provide a more efficient fireplace by effectively sealing the firebox from the room, thus preventing heat loss as the fire dies out.

A further object of the present invention is to provide an improved fireplace construction having the appearance of a masonry fireplace in which both the glass door and screen cover completely disappear within the system when these components are not in use.

In the present invention, there is provided a fireplace construction having means for selectively sealing the opening in the front of the combustion chamber, consisting of a glass door that is moved on a guillotine-like system to and from a closed position over the opening in the firebox. Sealing means on the glass door tightly engage the periphery of the firebox opening to preclude movement of air between the room and the firebox when the glass door is in a closed position. The invention also contemplates a guide means which disengages the door from its air-sealing relation with the firebox before movement of the door into a storage position.

BRIEF DESCRIPTION OF THE DRAWINGS

The objects and advantages of this invention may be more clearly understood from a consideration of the drawings in which.

DETAILED DESCRIPTION OF PREFERRED EMBODIMENTS

The fireplace of the present invention may have a visual appearance similar to that of the traditional masonry fireplace with the conventionally-appearing refractory lined fire chamber. The unit may be installed with a wide selection of decorative components, including, for example, a mantle that gives the unit all the appearances of a conventional masonry fireplace.

The fireplace is a zero clearance unit that is designed to fit into a chase that is approximately 24 inches by 48 inches, or slightly larger. Typically, the fireplace may have an opening of 36 inches. The outer shell of the unit may be appropriately and conventionally secured to studs or other supporting structure in a conventional manner.

Figure 1:
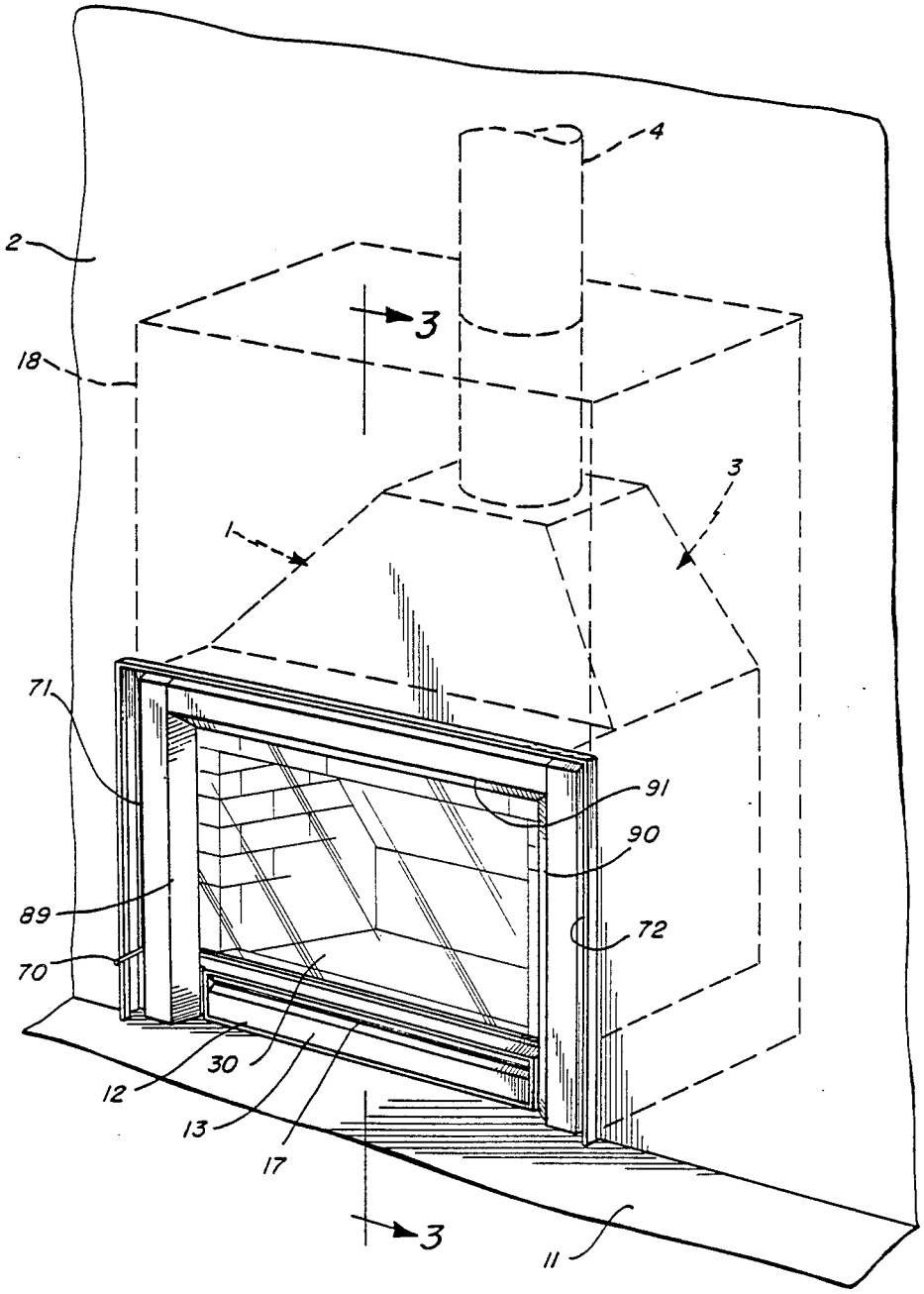
FIG. 1 is a perspective front view of a fireplace embodying a preferred form of the invention.
Figure 3:
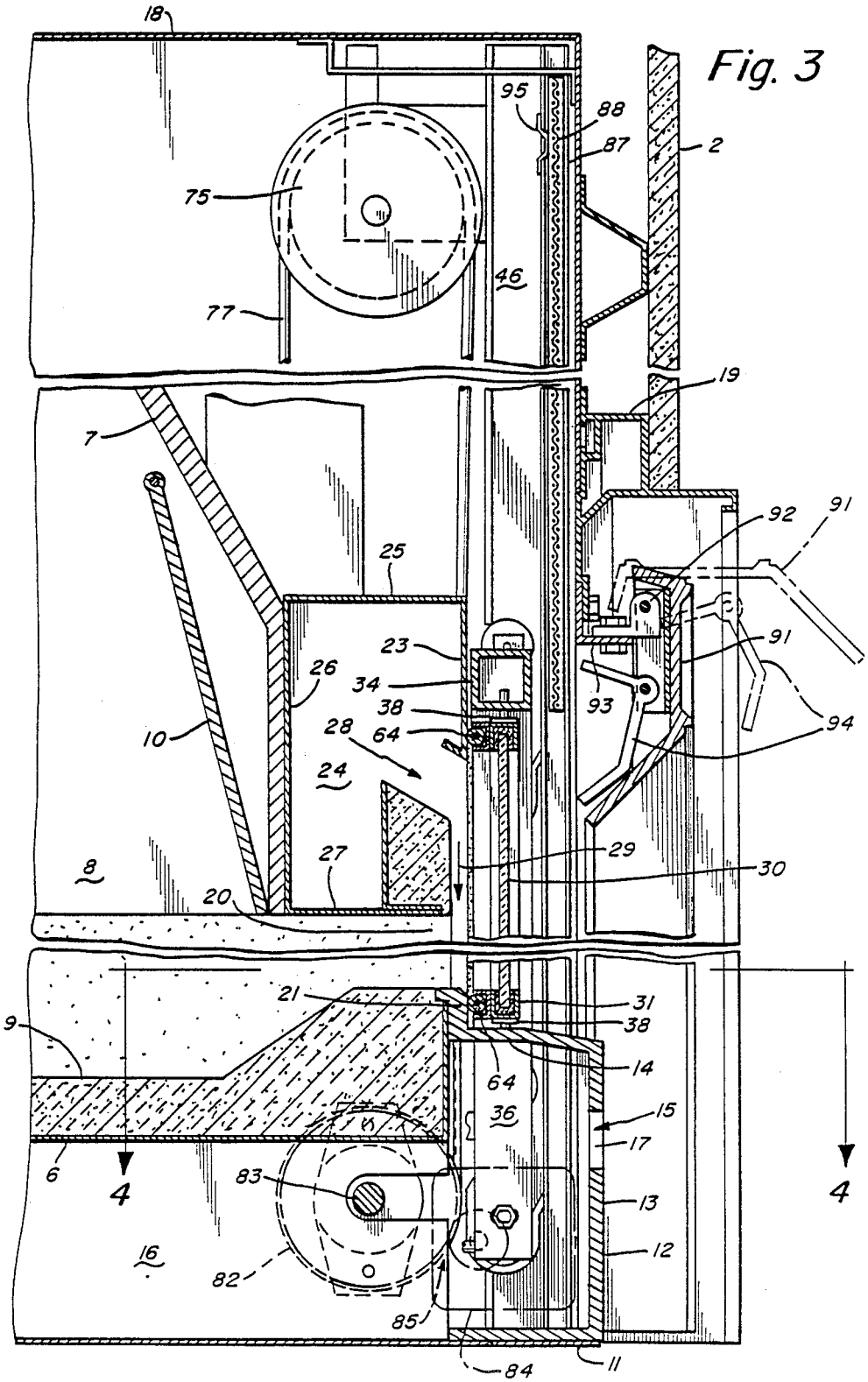
FIG. 3 is a cross-sectional view taken essentially along the line 3—3 of FIG. 1.

The fireplace 1 (FIG. 1) is designed for installation in a room having a wall 2. The unit is provided with a firebox 3 having a stovepipe, or exhaust 4. The firebox 3 is formed with walls 5 (FIG. 4), a floor 6 (FIG. 3) and top 7 that define a combustion chamber 8. The combustion chamber may be lined with refractory brick 9. Other conventional fireplace components such as a damper 10 may be provided. The floor 6 of the firebox is positioned in spaced relation to the room floor 11 by a bottom frame member 12. This bottom frame member 12 is formed with a forward wall 13 spaced from the forward end of the firebox 3 and is interconnected to it by a rearwardly-extending top wall 14 to form a plenum-like member 15 that interconnects with an air passage 16 between the floor 6 of the firebox and the room floor 11. Air slot 17 permits room air to flow into the plenum-like member 15 and air passage 16. The forward wall 13 is vertically aligned with the rear surface of wall 2 and forms part of an essentially rectangular outer shell 18 that contains the fireplace unit and fits within the chase. Suitable vertical and horizontal frame members 19 (FIGS. 4 and 5) secure the walls of the steel shell 18 to the rear surface of the wall 2 and provide a reinforcing support for the unit. The front of the combustion chamber 8 is defined by a forward or peripheral wall having an opening 20 (FIG. 3). The peripheral wall is defined at its bottom by a shoulder 21 at the rear end of the wall 14, side flanges 22 (FIG. 4) at the forward edges of walls 5 (FIG. 4) and the forward wall 23 (FIG. 3) of the air duct, or channel 24. The air duct 24 is formed across the front of the combustion chamber at the upper edge of the wall 5 by walls 23, 25, 26 and 27. An air flow slot 28 is formed in wall 23 at the lower edge thereof to permit flow of air in the direction of arrow 29 downwardly across a glass door 30 when the door is in a closed position as illustrated in FIG. 3. The ends of the air duct, or channel 24, are connected by a closed passage (not shown) to opposite side walls of the shell 18. A suitable air control valve is provided in these closed passages near the side walls. Means (also not shown) are provided for selectively connecting the ends of these closed passages at the air valves to either an outside air source directly or, if desired by the installer, to a room air source.

Figure 2:
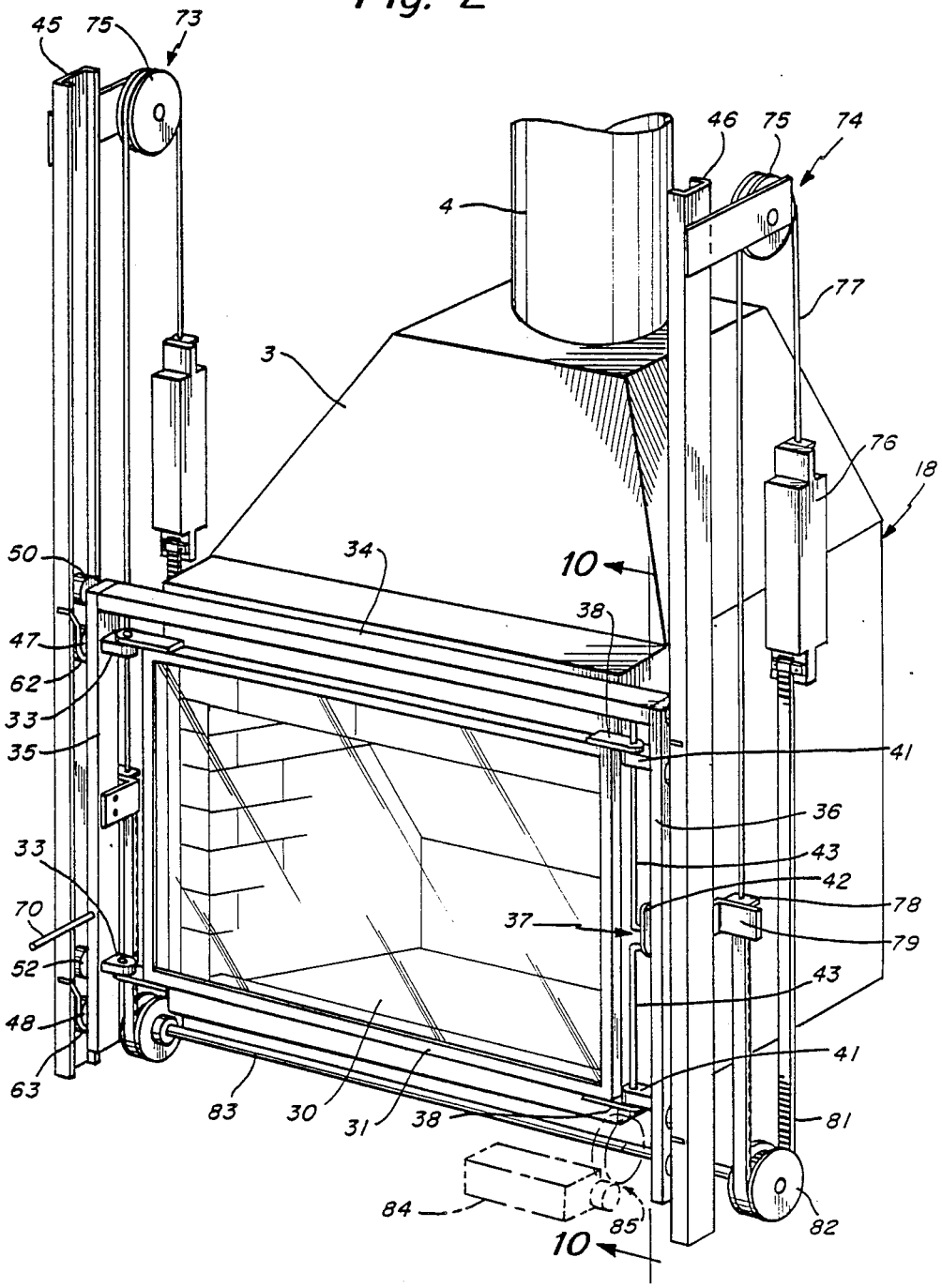
FIG. 2 is a somewhat schematic perspective view of the embodiment of FIG. 1 with outer components removed.
Figure 10:
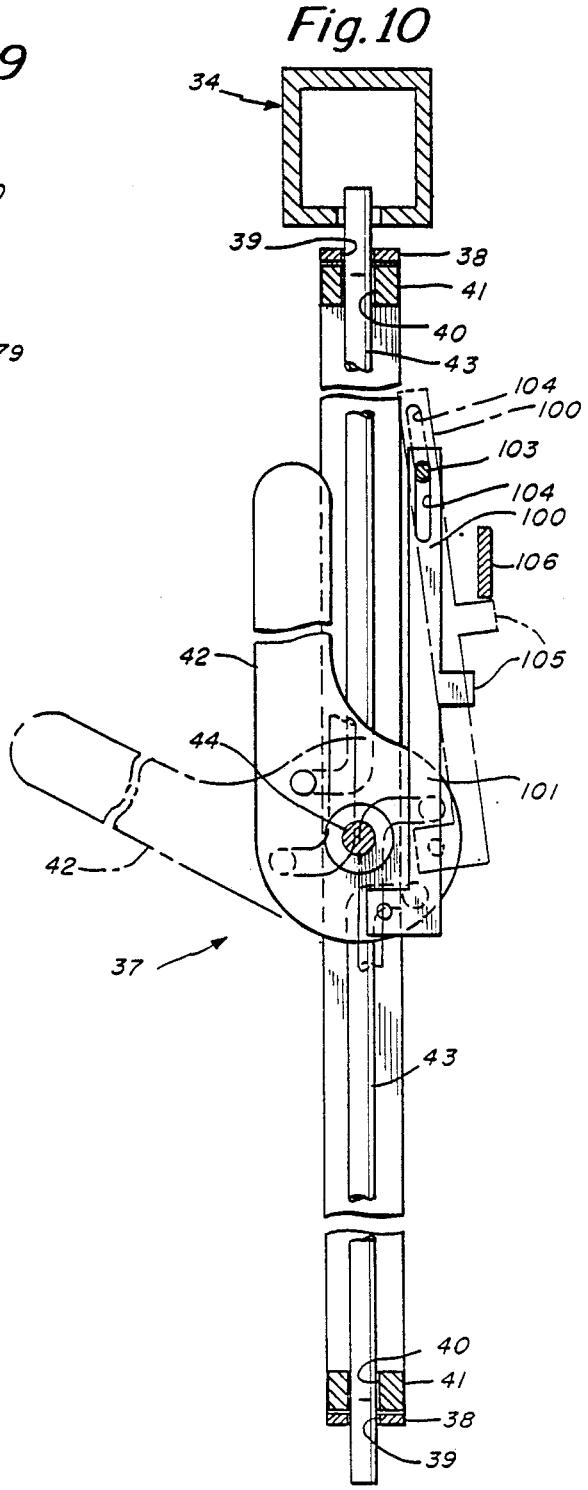
FIG. 10 is a cross-sectional view taken along the line 10—10 of FIG. 2.

The glass door 30 (FIG. 4) includes a continuous rectangular frame 31 about its sides, top and bottom, preferably with a sealing member 32 between the door glass and the frame 31. As best illustrated in FIG. 2, one vertical edge of the frame 31 is hinged by hinges 33 to an inverted, U-shaped slider 34. The U-shaped slider 34 is provided with legs 35 and 36. A latch system 37, on the edge of the leg 36 opposite hinges 33, secures the door 30 closed. The latch system 37 is illustrated in detail in FIG. 10. A pair of dogs 38 project outwardly from the side of frame 31. These dogs are formed with holes 39 that align with holes 40 in bearings 41. Bearings 41, in turn, are fixed to leg 36 in spaced and aligned relation with one another on above and below latch handle 42. Latch handle 42 is pivotally secured to the frame leg 36 and pivotally engages one end of each of the sliding pins, or bolts 43. The other ends of these pins, or bolts 43 are supported for vertical sliding movement in holes 40. On alignment of holes 39 and 40, the handle 42 may be pivoted about its pivot point 44, as illustrated by the phantom outline in FIG. 10, to slide the pins 43 into locking engagement with the dogs 38 and through the hole in slider 34.

The U-shaped slider 34 is supported for vertical sliding movement by a pair of vertically oriented channels 45 and 46 (FIG. 2). These channels, 45 and 46, are parallelly aligned with one another on the outer sides of legs 35 and 36 and are suitably secured in fixed relation to the outer shell 18 by suitable bracket means. The slider 34 is guided for vertical movement in the channels 45 and 46 by means best illustrated in FIGS. 4–8. The legs 35 and 36 are supported by a plurality of wheels that engage the channels 45, 46 as hereafter described. The wheel arrangement, interengaging leg 36 within channel 46, is similar and symmetrical with respect to the wheel arrangement that supports leg 35 in channel 45 as hereafter described. As illustrated in FIGS. 5–8, wheels 47 and 48 are secured for rotation about fixed shafts at the upper and lower end, respectively, of leg 35. The wheels 47 and 48 are fixed to the leg 35 to engage and roll against the inner surface of flange 49 of channel 45 (FIG. 6), when the frame 31 is other than in the closed position of FIG. 5. When the frame 31 is moved to a closed position, as illustrated in FIG. 5, the wheels 47 and 48, along with the frame 31, move away from flange 49. Leg 35 also carries movable wheels 50 and 52. Wheels 50 and 52 are rotatably secured to shafts carried on an L-shaped levers 51, 53, respectively. These levers support shafts for wheels 50, 52 at one end, and are engaged by springs 54, 55 at the other end. The springs, in turn, have one end fixed to the leg 35, so that these L-shaped levers 51 and 53 may pivot about pivot supports 56 and 57, with the wheels 50, 52 normally maintained by the springs 54 and 55 under tension against the inner surface of flange 58 that forms a sidewall of the channel 45. The flange 58 has openings 60 and 61, spaced apart along the flange 58 a distance equal to the distance between the wheels 50 and 52. The flange 58 is also formed with a pair of U-shaped offsets 62 and 63, located a distance apart equal to the distance between wheels 47 and 48.

Figure 6:
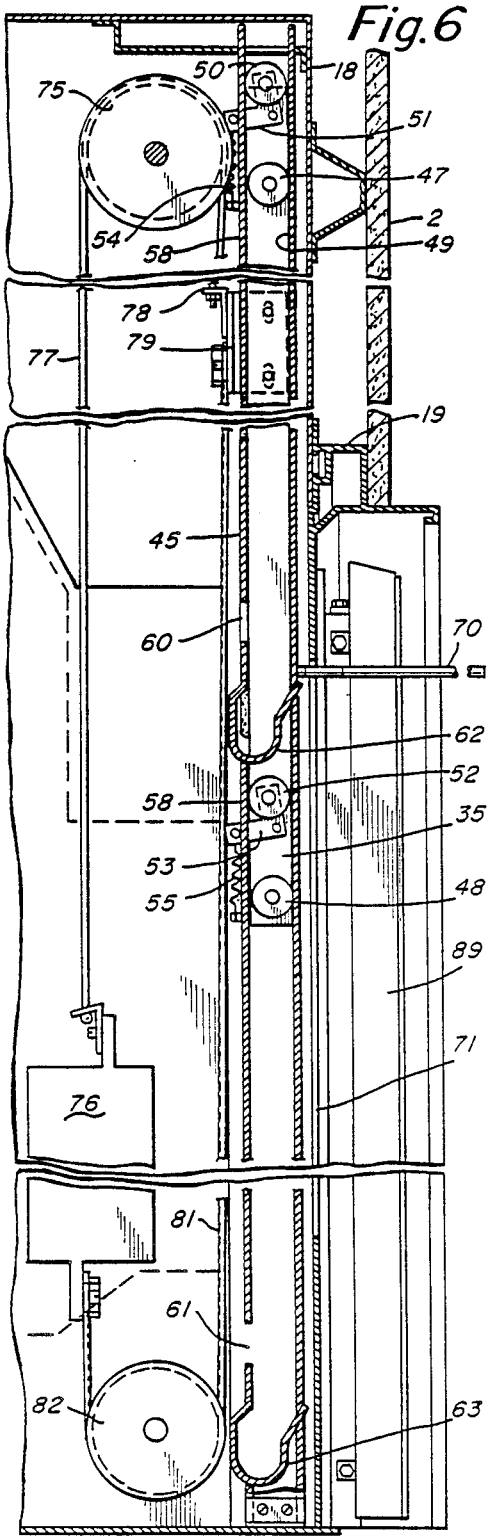
FIG. 6 is a cross-sectional view taken along the same line in FIG. 4 as FIG. 5, but with the door in an up position.

When the frame 31 is in an up position, as illustrated in FIG. 6, the frame 31 is aligned with the channels 45 and 46 with the wheels 47 and 48 pressing against flange 49, and wheels 50 and 52 spring-loaded and pressing against flange 58, as illustrated in FIG. 6. On downward movement of the frame 31, the wheels 50 and 52 partially move into the openings 60 and 61, under the influence of the forces generated by springs 54 and 55, through the levers 51 and 53. At the same time, the wheels 47 and 48, which in an up position bear against flange 49, move away from the flange 49 in the lowermost closed position into the U-shaped offsets 62 and 63. The openings 60, 61 are sized to permit lateral movement of the frame 31 into an airtight sealing position only at the lowermost or shut position of the door 30.

Figure 4:
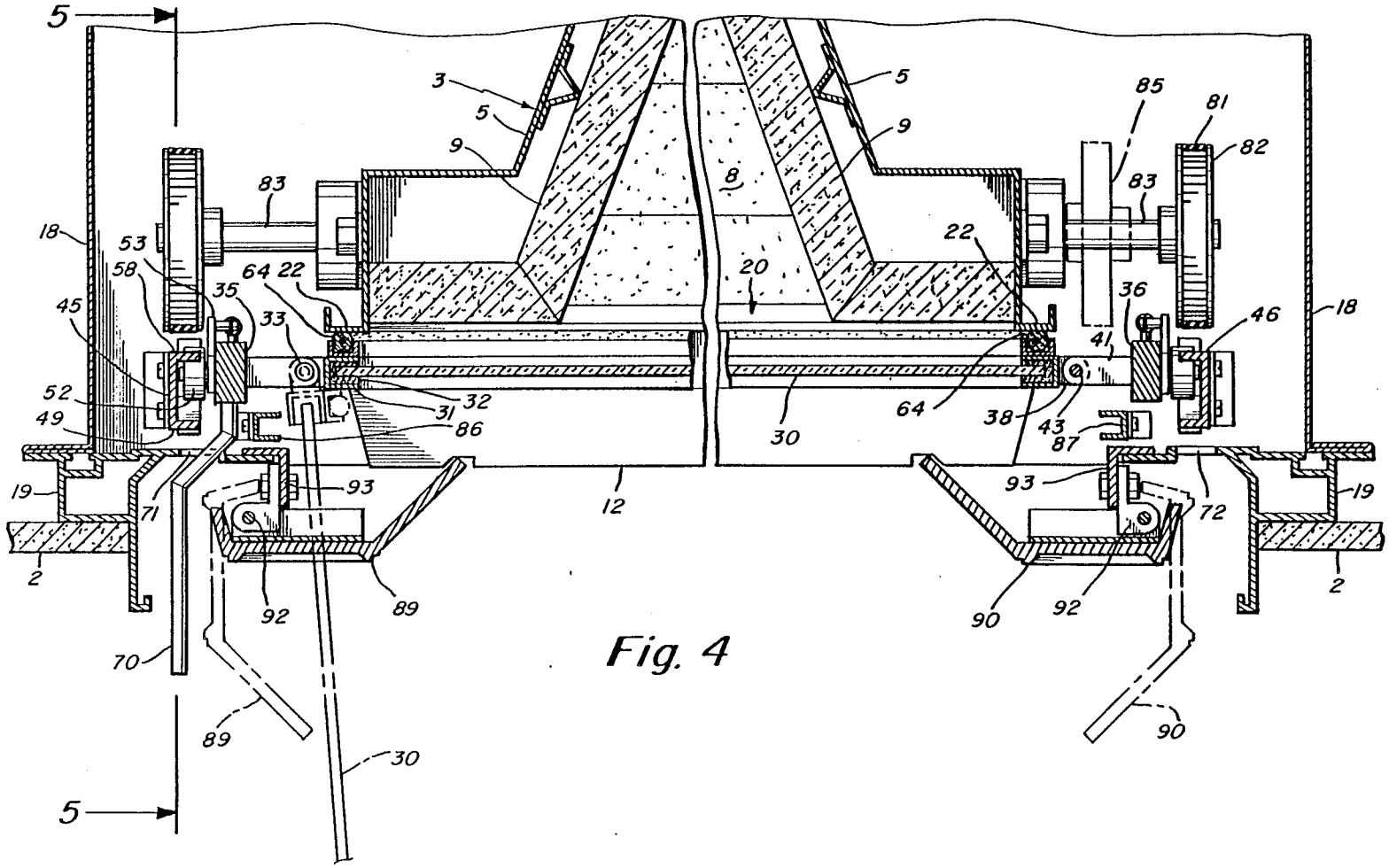
FIG. 4 is a cross-sectional view taken along the line 4—4 of FIG. 3.
Figure 5:
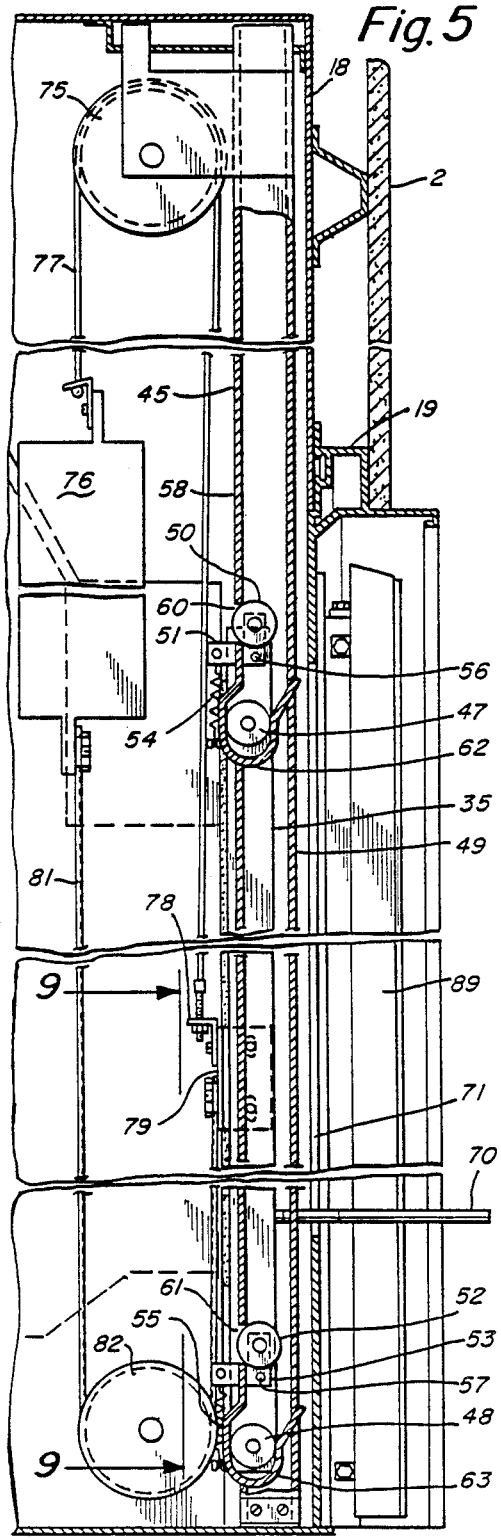
FIG. 5 is a cross-sectional view taken essentially along the line 5—5 of FIG. 4 with the door in a down position.

In this lowermost position, the glass door 30, as illustrated in FIG. 4, effects an airtight seal over the opening in the forward wall of the combustion chamber by engagement of a gasketing means, or seal 64, carried by the frame 31 with the forward wall 22 of the firebox 3. The gasketing, or sealing means 64 includes a resilient seal, secured by a suitable frame bracket to the rear surface of the frame 31. The seal, or gasket, is preferably made of a heat-resistant, compressive insulator adapted to conform with and close the space between the glass door 30 and the wall 22 when the door is in its down, or closed, position. This seal, or gasket means extends entirely around the frame 31 and provides an effective air seal about the entire opening into the combustion chamber 8 when the door 30 is shut. As noted above, the sliding mechanism is symmetrical with respect to the supports for legs 35 and 36 and, therefore, there is not need to specifically describe the like elements on legs 36 that support the door 30 for vertical sliding movement to and from a sealed position over the combustion chamber. The U-shaped offsets 62 and 63 coupled with the openings 60, 61 function to secure the glass door in its closed, down position by engagement with the wheels they respectively engage when the glass door is closed. The engagement, however, is such that a slight force on the inside of the glass door will move it from its sealed position to a position in which the wheels may freely move in the channels 45, 46. In this position, the counterweights hereafter described cause the door to move upwardly to a normal open position.

Means are provided for preventing upward movement of the slider when the door 30 is pivoted open. These means include a (FIG. 10) that is pivotally secured at its lower end 101 to an offset section of the lower end of handle 42. The other end of link 100 is secured by a pin 103 that is slideably fixed in slot 104. The link 100 has a dog 105 that projects rearwardly. In a normal closed position of the door 30, this dog does not encounter any interference. However, when the latch 42 is opened, the dog 105 is toggled into an interfering fit with a stationary stop 106 fixed to the channel 46 on a support member, thus preventing upward movement of the slider and, consequently, the door 30 which it supports.

A handle 70 (FIG. 2), secured at one end to the lower portion of leg 35, may be used to manually raise or lower the glass door 30. One end of the handle 70 is secured preferably to the lower end of leg 35, and the other end of handle 70 projects through a vertically-extending slot 71 (FIG. 4) in the vertical frame 19. A similar slot 72 extends vertically to the right of the glass door in the frame. The slots 71 and 72 provide air passage openings that connect the room and the space between the outer surface of firebox 3 and the outer enclosure, or shell 18. The area thus defined permits convection air to move between the room and the area surrounding the combustion chamber 8, but with this air isolated from the combustion chamber.

The seal 64 that engages the wall 23 across the top of the combustion chamber is also positioned above the slot 28 in the air duct, or channel 24. Air flowing through the slot 28 is directed downwardly against the inner surface of glass door 30 and is sealed against escape between the door 30 and wall 23 by the gasket means 64. This downward flow of heated air from the combustion chamber against the inner surface of the glass, provides an air sweep which minimizes particulate buildup on the inner surface of the glass.

Figure 9:
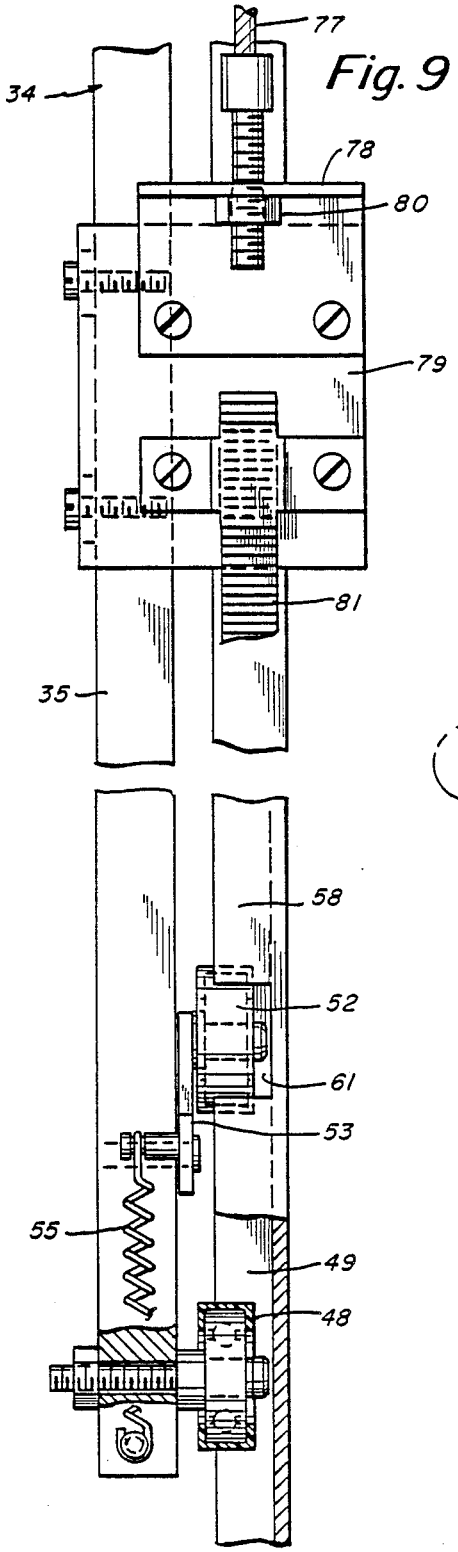
FIG. 9 is a fragmentary cross-sectional view taken along the line 9–9 of FIG. 5.

A pair of symmetrically arranged means are provided for automatic raising and lowering of the glass door 30. This means includes a symmetrically arranged pair of counterweight and pulley means, generally illustrated in FIG. 2 at 73 and 74. Each of these pulley means includes a pulley 75 suitably supported by shafts fixed to the channels 45, 46. A counterweight 76 has a cable 77 connected at one end, with the cable extending around the pulley 75 and connected at the other end to a bracket 78. The bracket 78, in turn, is connected to the legs 35, 36 of the slider 34 by a suitable means, such as a flange 79, cable 71 extends through bracket 78 and is secured thereto by a nut 80 or other suitable means (see FIG. 9). Flange 79 also secures a belt or roller chain 81 which extends below a lower pulley 82 with the other end of the belt or roller chain 81 connected to the counterweight 76. The pulley 82 is secured to a shaft 83 that extends across the bottom of the fireplace and is suitably supported by bearings on the walls of the shell or other suitable means.

If desired, an electric motor 84 is operatively interengaged with the shaft 83 through a gear train 85 that may be of conventional design operated by limit switches, by torque load resistance or by motion detection. The gear train 85 may include a friction wheel drive system for safety purposes. A suitable but conventional on-off switch, accessible from the front of the unit, may be provided for motor control. When the motor is controlled by limit switches, the power to the motor is turned on by an on-off switch. On movement of the door, a limit switch is engaged when the door reaches a full open or closed position, and the power is turned off and the reversal motor is reversed.

The combined weight of the counterbalance weights 76 are greater than the weight of the door 30, frame or U-shaped slider 34 and such additional elements as may be fixed to the slider 34. By providing counterweights that are heavier than the door and frame, a positive action holds the door in an open position.

Figure 7:
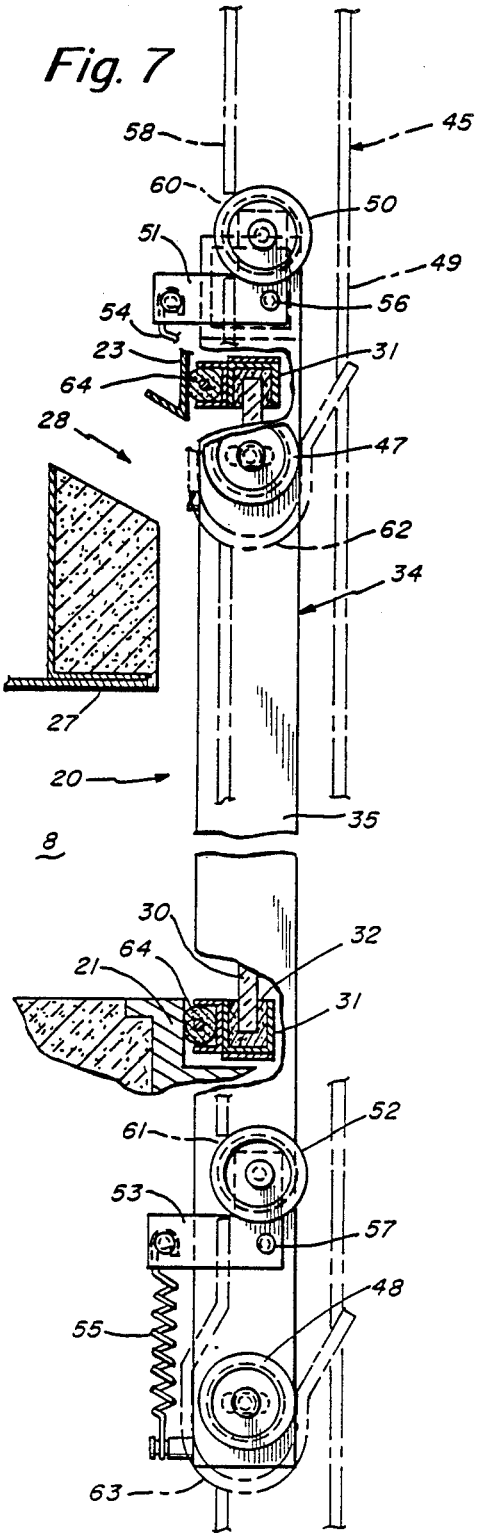
FIG. 7 is a fragmentary enlarged portion of FIG. 5 with components broken away.

As illustrated in FIG. 7, the door 30 is secured in an airtight seal over the opening in the combustion chamber 8 by engagement of the gasket means 64 with the forward wall 23 at the upper edge of the opening in the combustion chamber and by engagement of the gasket means 64 with shoulder 21 at the lower edge of the opening. The seal is continuous around the side to provide an airtight chamber in which the space between the forward wall of the air duct 24 and the glass door is constricted, thereby providing a narrow passage through which the air from air duct 24 may pass close to and against the inner surface of the glass door.

Figure 8:
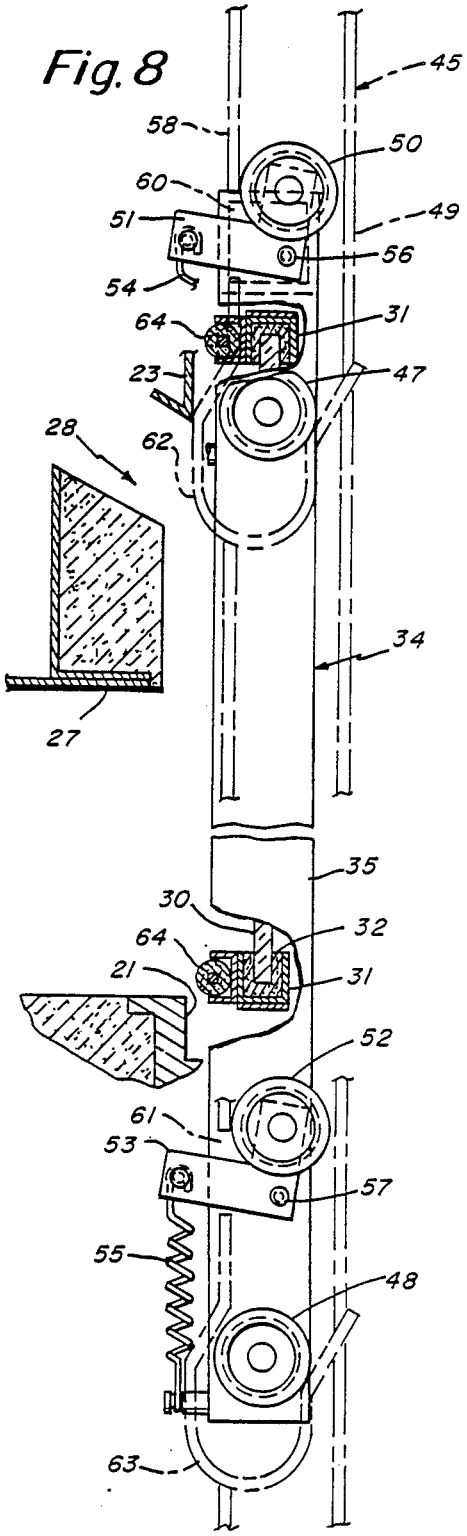
FIG. 8 is an enlarged portion of FIG. 5 similar to that of FIG. 7, but with the door slightly raised.

As illustrated in FIG. 8, the gasket means 64 is moved laterally from engagement with the forward walls 23 at the beginning of the upward motion of the door door. By moving the gasket from engagement with the wall 23 at the beginning of the upward movement, wear on the gasket is minimized and the upward movement of the door 30 is facilitated.

A pair of vertically-extending parallel screen tracks 86 and 87 (FIG. 4), having opposed C-shaped cross sections, are aligned vertically on either side of the fireplace and are suitably secured to the shell 18. This screen track supports the opposite side of a wire mesh screen that is adapted to be slid vertically in the screen tracks 86 and 87 from a position directly across, and over, the opening in the combustion chamber to an up position above the opening in the combustion chamber and concealed behind the wall 2. The screen 88 (FIG. 3) is positioned in front of the door 30 and must be raised to an up position, with its lower edge above the upper edge of the glass door, to permit the glass door to be pivoted to an open position. When the screen is in an up position, the glass door 30 may be pivoted open by unlocking the latch system 37 as described above and then swinging the door open from the full position to its phantom position shown in FIG. 4.

Prior to opening the door 30 to the position shown in phantom outlined in FIG. 4, covers, or jamb doors 89, 90 and 91 (FIG. 3) must also be opened. These jamb doors 89, 90 and 91 are provided for cosmetic purposes to cover the periphery of the glass door 30. The doors may be suitably styled or decorated. Jamb doors 89 and 90 are best illustrated in FIG. 4. These doors are pivotally supported at their upper and lower ends by hinge members 92 that interengage one edge of the jamb doors 89 and 90 with the vertical frame 19 by means of angle member 93. The vertical jamb doors 89 and 90 may thus be pivoted from a closed position, as illustrated in FIG. 4 in which they cover the side edges of the door and its frame 31, as well as side edges of the screen 88. These jamb doors may be pivoted to the position illustrated in phantom outline when the door 30 is to be opened. Illustrated in FIG. 3 is the jamb door 91 which covers the upper edge of the door frame 31. This jamb door 91 is also pivotally secured by hinges 92 at its ends to the frame 19. A spring latch 94 secures the jamb door 91 in an open position when the glass door is being opened.

When the screen 88 is in is up position to permit opening of the door 30, it may be secured by a friction spring 95 that engages the frame of the screen when it reaches its uppermost position or by a counterweight approximately equalling the weight of the screen 88 or other suitable means.

Having now described our invention, we claim:

1. A fireplace construction having means for selectively sealing the room opening in the front of a combustion chamber in said fireplace comprising:

a door sized and shaped for positioning over said opening, guide means engaging said door for guiding vertical movement of said door between a lowered position over the opening in said front of said fireplace and a raised position vertically displaced therefrom, means supporting said door for movement in said guide means, means for moving said support means and door to said raised position unless said door is secured in said lowered position, and means for selectively securing said door in said lowered position, including means for releasing said door from said lowered position when it is pushed outwardly from within the combustion chamber.

2. A fireplace construction as set forth in claim 1 wherein said means for moving said support means and said door includes a counterweight and pulley arrangement coupled to said support means and further including a motor, gear and shaft means for interengaging said counterweight and pulley arrangement whereby said door is raised or lowered when said motor is energized.

3. A fireplace construction as set forth in claim 2 including switches operatively controlling said motor and having means for being actuated when said door encounters blockage that interferes with its downward motion.

4. A fireplace construction as set forth in claim 3 wherein said switches have means for reversing motion and causing said door to move and come to rest in fully open position.

5. A fireplace construction having means for selectively sealing the room opening in the front of a combustion chamber in said fireplace comprising:

a door sized and shaped for positioning over said opening, guide means engaging said door for guiding vertical movement of said door between a lowered position over the opening in said front of said fireplace and a raised position vertically displaced therefrom, means supporting said door for movement in said guide means, and hinge means for securing said door to said support means and for pivoting said door about a vertical axis when said door is in said lowered position, said hinge means including hinges at one side of said door for pivoting said door about said vertical axis, and a pair of vertically extending jamb doors with one each positioned in front of each side edge of said door providing a cover for the side edges of said door, and hinge means engaging said jamb doors for pivotal movement away from said door to permit said door to open without interference from said jamb doors.

6. A fireplace construction as set forth in claim 5 including a horizontal jamb door positioned in front of the upper edge of said glass door, said jamb doors collectively providing a cover for the periphery of said door, and hinge means engaging said horizontal jamb door for pivotal movement away from said door to permit said door to open without interference from said jamb door.

7. A fireplace construction as set forth in claim 6 including a mesh fire screen, guide means for guiding said screen vertically to and from a position over said combustion chamber, said screen guide means positioned between said door guide means and said jamb doors.

8. A fireplace construction having means for selectively sealing the opening in the front of a combustion chamber of the fireplace comprising:

a door sized and shaped for positioning over said opening, and guide means engaging said door for guiding vertical movement of said door between a lowered position over the opening in said front of said combustion chamber and a raised position vertically displaced therefrom, said guide means including means for guiding said door to an air-sealing relation with said front of said fireplace when positioned over said opening, and from said air-sealing relation for movement of said door to said raised position, said guide means further including means for displacing said door inwardly into said air sealing relation at the lowermost portion of its travel so as to prevent friction between said door and said combustion chamber as said door is raised and lowered, said guide means including a pair of vertically extending parallel channels positioned one on either side edge of said door, said channels having means for guiding said door vertically as said door is moved upwardly and means for guiding said door in a lateral displacement toward and away from said opening when said door is in its lowermost position whereby said door is in said air-sealing relation only when said door is in its lowered position, said guide means including a slider within which said door is secured, said slider having a plurality of wheels positioned on its outer side edges, and said wheels engaging said parallel channels for guiding said slider in vertical movement, said channels each being provided with spaced means that permit parallel displacement of the axis of said wheels when said door is in its down position over said combustion chamber opening, and means for urging said wheels into said parallel displaced position when said door is in its down position, said means for urging said wheels including means rotatably mounting at least a pair of the axis of said wheels for lateral movement and spring loading means tensioning said pair of axis of said wheels toward one of the flanges of said channels, and said spaced means that permit lateral movement including an opening in said flanges of said channels.

9. A fireplace construction having means for selectively sealing the opening in the front of a combustion chamber of the fireplace comprising:

a door sized and shaped for positioning over said opening, guide means for engaging said door for guiding vertical movement of said door between a lowered position over the opening in said front of said combustion chamber and a raised position vertically displaced therefrom, said guide means including means for guiding said door to an air-sealing relation with said front of said fireplace when positioned over said opening, and from said air-sealing relation for movement of said door to said raised position, said guide means further including means for displacing said door inwardly into said air-sealing relation at the lowermost portion of its travel so as to prevent friction between said door and said combustion chamber as said door is raised and lowered, said guide means including a pair of vertically extending parallel channels positioned one on either side edge of said door, said channels having means for guiding said door vertically as said door is moved upwardly and means for guiding said door in a lateral displacement toward and away from said opening when said door is in its lowermost position whereby said door is in said air-sealing relation only when said door is in its lowered position, said guide means including a slider within which said door is secured, said slider having a plurality of wheels positioned on its outer side edges, and said wheels engaging said parallel channels for guiding said slider in vertical movement, means securing said door in said slider comprising hinges interengaging one side of said door and one leg of said slider for pivoting motion of said door between a closed position over the opening in said combustion chamber and an open position, and a latch mechanism for retaining said door in a closed position including a handle and a link connected at one end to an offset portion of said handle and pivotally secured at the other end to said slider, said link including a dog adapted to be pivoted from a stored position when said handle is closed to a position in interfering relation with a fixed member, whereby movement of said slider is limited.

* * * * *